US005233268A

United States Patent [19]

Heuvelmans et al.

[11] Patent Number: 5,233,268

[45] Date of Patent: Aug. 3, 1993

[54] LOW-PRESSURE MERCURY VAPOR DISCHARGE LAMP

[75] Inventors: Jean J. Heuvelmans; Franciscus A. S. Ligthart, both of Eindhoven, Netherlands

[73] Assignee: U.S. Philips Corporation, New York, N.Y.

[21] Appl. No.: 804,567

[22] Filed: Dec. 10, 1991

[30] Foreign Application Priority Data

Dec. 17, 1990 [NL] Netherlands ..... 9002771

[51] Int. Cl.[5] ..... H01J 17/04; H01J 61/04

[52] U.S. Cl. ..... 313/491; 313/492

[58] Field of Search ..... 313/491, 492, 493

[56] References Cited

U.S. PATENT DOCUMENTS 3,013,175 12/1961 Waymouth et al. ..... 313/492 X 3,706,895 12/1972 Martyny et al. ..... 313/42

*Primary Examiner*—Sandra L. O'Shea

*Attorney, Agent, or Firm*—Brian J. Wieghaus

[57] ABSTRACT

A low-pressure mercury vapour discharge lamp having a tungsten coil electrode which is supported at either end by a respective current supply wire and which has emitter-coated central turns and, on either side thereof, end turns which are free from emitter. Each of the current supply wire ends with adjoining end turns of the coil is surrounded by an electrically insulating sleeve, such as a glass tube, as a result of which the switching life of the lamp is considerably increased.

15 Claims, 1 Drawing Sheet

LOW-PRESSURE MERCURY VAPOR DISCHARGE LAMP

BACKGROUND OF THE INVENTION

The invention relates to a low-pressure mercury vapour discharge lamp having a closed discharge vessel which contains mercury and rare gas and within which electrodes are positioned between which the discharge is maintained during operation, each electrode being formed by a tungsten coil supported at either end by a respective current supply wire, which coil has central turns covered with at least one emitter and, on either side thereof, end turns which are free from emitter.

Low-pressure mercury vapour discharge lamps of the kind described are well-known. Such lamps include, for example, fluorescent lamps constructed as straight tubes as, for example, disclosed in U.S. Pat. No. 3,937,998, and compact fluorescent lamps as, for example, disclosed in U.S. Pat. Nos. 4,374,340 and 4,546,285.

The emitter on the central turns of the tungsten coil provides a reduction of the emission potential of electrons emitted by the tungsten coil during operation of the lamp. A mixture of barium oxide, strontium oxide, and calcium oxide, for example, is used as an emitter. The barium therein is the main active ingredient, while the strontium and the calcium reduce the vapour pressure of the barium. During the manufacture of the lamp, triple carbonate (Ba-Sr-Ca carbonate) is provided on the central turns and converted into Ba-Sr-Ca oxide by heating through passage of electric current through the tungsten coil, whereby $CO_2$ is evolved. The end turns and the current supply wire ends are not coated with emitter because the temperature of the end turns and the current supply wire ends remains too low during passage of current for a good conversion of the triple carbonate into oxides to be realised. This would mean that later, in the finished lamp, $CO_2$ would be evolved during operation, which is disastrous for lamp life.

Low-pressure mercury vapour discharge lamps can be subdivided into so-called hot starting and cold starting lamps. In hot starting lamps, the tungsten coil is preheated before ignition of the lamp in that an electric current is passed through it. In cold starting lamps, the discharge is initiated by a glow discharge at he area of a tungsten coil, for example, between one tungsten electrode and an ignition strip which is connected to the other tungsten electrode, or between the two electrodes.

A problem with cold starting low-pressure mercury vapour discharge lamps is the switching life of the lamps. It has been found that the lamps reach the end of their lives already after a comparatively low number of on/off switching operations.

SUMMARY OF THE INVENTION

The invention has for its object to provide an improved low-pressure mercury vapour discharge lamp which has a longer switching life because of a greater switching resistance.

To achieve the envisaged object, a low-pressure mercury vapour discharge lamp of the kind mentioned in the opening paragraph is characterized in that each of the current supply wire ends together with the adjoining end turns of the tungsten coil is surrounded by an electrically insulating sleeve.

The invention is based on the recognition that during starting of the lamp the transition from the glow discharge to the arc discharge at the tungsten coil takes place preferably at the area of the end turns of the coil not coated with emitter, near the ends of the current supply wires, with the result that a "hot spot" in the end turns will lead to the end of the life of the coil. By electrically insulating the end turns and the current supply wire ends from the discharge, the discharge is forced to strike at the emitter-coated central turns of the tungsten coil, and a much longer switching life is surprisingly found to be obtained.

The electrically insulating sleeve may be provided, for example, as a layer, for example, by means of the so-called CVD technology (chemical vapour deposition).

A favourable embodiment of a low-pressure mercury vapour discharge lamp according to the invention is characterized in that the electrically insulating sleeve consists of a glass tube which is closed at the side of the discharge.

Preferably, the glass tube is provided with a slot in axial direction through which the tungsten coil is passed. The slot renders it possible to slide the glass tube simply over the end turns and the adjoining current supply wire end.

A further favourable embodiment of a low-pressure mercury vapour discharge lamp according to the invention is characterized in that the glass tube is fixed around the current supply wire end through fusion by heating.

BRIEF DESCRIPTION OF THE DRAWING

The invention will be explained with reference to a drawing.

In the drawing.

DESCRIPTION OF THE PREFERRED EMBODIMENT

Figure 1:
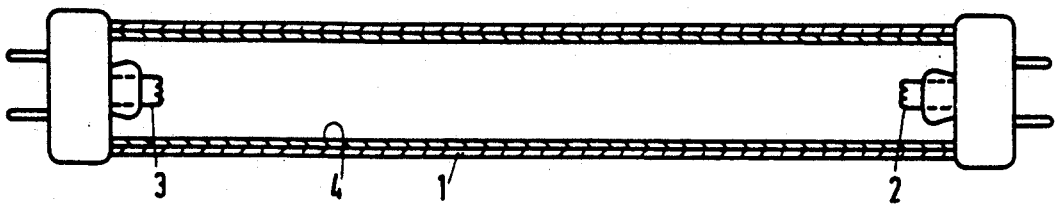
FIG. 1 shows a known low-pressure mercury vapour discharge lamp in longitudinal section.

The low-pressure mercury vapour discharge lamp of FIG. 1 has a closed glass discharge vessel 1 which contains mercury and a rare gas, for example argon, as a starting gas. Electrodes 2 and 3 (tungsten coils) are arranged inside the discharge vessel 1, between which electrodes the discharge is maintained during lamp operation. The discharge vessel 1 is provided on its inside with a luminescent layer 4 which comprises at least one luminescent material which emits visible radiation upon excitation by mainly 254 nm radiation from the mercury discharge.

Figure 2:
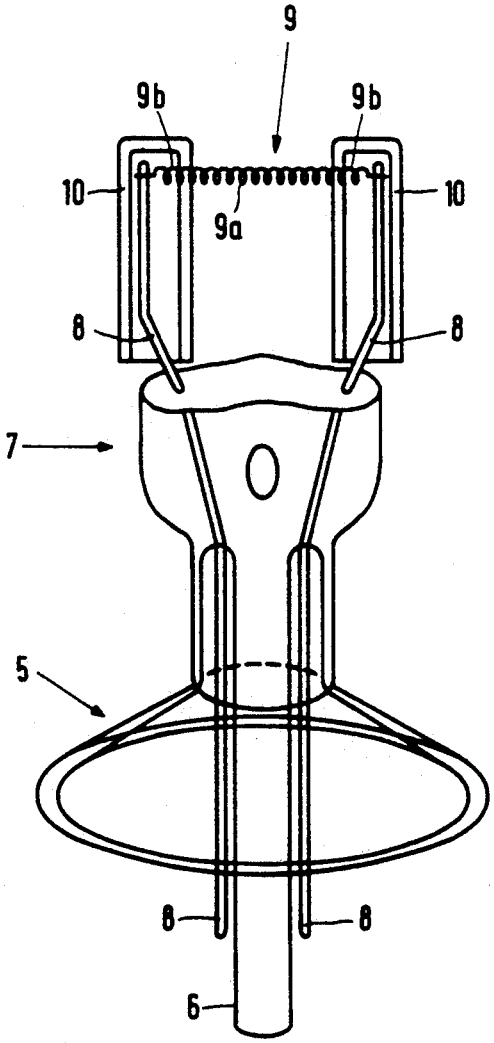
FIG. 2 shows a mount with electrode construction for use in a low-pressure mercury vapour discharge lamp according to the invention.

In FIG. 2, the reference numeral 5 denotes a glass stemtube which is provided with an exhaust tube 6 and a pinch seal 7 in known manner. Two current supply wires 8 are sealed into the pinch seal 7 and support a tungsten coil electrode 9. The tungsten coil 9 has central turns *9a* which are coated with an emitter, for example BaO in combination with SrO and CaO, and end turns *9b* on either side thereof not coated with emitter. The number of non-coated end turns is determined in practice by margins in the emitter coating process and the degassing process. The safety margin used is a distance of 1 to 2 mm from the current supply wires to the emitter, which implies a varying number of non-coated end turns for the various electrodes. A glass tube 10 is fitted around each end of the two current supply wires 8 and around the adjoining end turns 9*b*, which tube is provided with a slot (not visible) in axial direction through which the tungsten coil 9 is passed. The glass tube 10 is closed at the top, i.e. at the discharge side in a lamp, so that the end of the current supply wire 8 and the end turns 9*b* are electrically insulated from the discharge. As a result, the discharge can only strike at the central turns 9*a* coated with emitter. It is achieved in this way that the switching life of the lamp is considerably increased.

The glass is softened in that the glass tube 10 is heated with a burner, and the tube fixed itself around the current supply wire 8, possibly after pinching.

During tests with compact fluorescent lamps of the PLC-E type (electronic lamp having four interconnected parallel discharge tubes in a square arrangement), in which the number of end turns not coated with emitter at either end of the tungsten coil was approximately 7, the end of the switching life of the lamp was achieved after approximately 8,000 on/off switching operations without a glass tube 10. When lamps of the same batch were provided with the glass tubes 10, the end of the switching life of the lamp was not reached until after approximately 11,000 on/off switching operations.

We claim:

1. A low-pressure mercury vapour discharge lamp having a closed discharge vessel which contains mercury and rare gas and within which electrodes are positioned between which the discharge is maintained during operation, each electrode being formed by a tungsten coil supported at either end by a respective current supply wire, which coil has central turns covered with at least one emitter and, on either side thereof, end turns which are free from emitter, characterized in that:

each of the current supply wire ends together with the adjoining end turns of the tungsten coil which are free of emitter is surrounded by an electrically insulating sleeve.

2. A low-pressure mercury vapour discharge lamp as claimed in claim 1, characterized in that the electrically insulating sleeve consists of a glass tube which is closed at the side of the discharge.

3. A low-pressure mercury vapour discharge lamp as claimed in claim 2, characterized in that the glass tube is provided with a slot in axial direction through which the tungsten coil is passed.

4. A low-pressure mercury vapour discharge lamp as claimed in claim 3, characterized in that the glass tube is fixed around the current supply wire end through fusion by heating.

5. A low-pressure mercury vapour discharge lamp as claimed in claim 2, characterized in that the glass tube is fixed around the current supply wire end through fusion by heating.

6. A cold-starting low pressure mercury vapor discharge lamp having improved switching life, said lamp comprising:

a sealed discharge vessel;

a discharge sustaining filling within said discharge vessel including mercury and a rare gas;

a pair of discharge electrodes between which a gas discharge is maintained during lamp operation, each electrode comprising a filament coil having a plurality of coil turns extending between opposing ends of sad electrode;

a respective pair of current supply wires between which each electrode is supported, each current supply wire having end portions connected to a respective electrode end, each filament including a plurality of central turns covered with an emitter and end turns, between said central turns and each respective current supply wire end portion, which are free of an emitter, and means for electrically insulating said end portion of said current supply wires and said end turns which are free of emitter such that the gas discharge strikes only at the central coil turns covered with emitter and not on said end portions of said current-supply wires or said end turns.

7. A cold-starting low pressure mercury vapor discharge lamp according to claim 6, wherein said lamp is a fluorescent low-pressure mercury vapor discharge lamp including a coating of phosphor on an inner wall of said discharge vessel.

8. A cold-starting low pressure mercury vapor discharge lamp according to claim 7, wherein said lamp is a compact fluorescent lamp.

9. A cold-starting low pressure mercury vapor discharge lamp according to claim 7, wherein said means for electrically insulating includes a glass tube extending over each current supply wire end portion and said adjacent end turns which are free of an emitter, said tube being closed at its end facing the discharge.

10. A cold-starting low pressure mercury vapor discharge lamp according to claim 9, wherein said glass tubes each include an axial slot to allow said tubes to be slipped onto said current-supply wires over said electrode.

11. A cold-starting low pressure mercury vapor discharge lamp according to claim 10, wherein each glass tube is fused to its respective current supply wire by heating.

12. A cold-starting low pressure mercury vapor discharge lamp according to claim 6, wherein said means for electrically insulting is a layer provided by chemical vapour deposition.

13. A cold-starting low pressure mercury vapor discharge lamp according to claim 6, wherein said means for electrically insulating includes a glass tube extending over each current supply wire end portion and adjacent end turns which are free of an emitter, said tube being closed at its end facing the discharge.

14. A cold-starting low pressure mercury vapor discharge lamp according to claim 13, wherein said glass tubes each include axial slots to allow said tubes to be slipped onto said current supply wires over said electrode.

15. A cold-starting low pressure mercury vapor discharge lamp according to claim 14, wherein each glass tube is fused to its respective current supply wire by heating.

* * * * *